US005445058A

United States Patent [19]

Hoke, Jr.

[11] Patent Number: 5,445,058

[45] Date of Patent: Aug. 29, 1995

[54] LAMINATED MUSICAL INSTRUMENT NECKS

[76] Inventor: Clare L. Hoke, Jr., 1318 N. Monte Vista Ave., Upland, Calif. 91786

[21] Appl. No.: 175,739

[22] Filed: Dec. 30, 1993

[51] Int. Cl.[6] ..... G10D 3/00

[52] U.S. Cl. ..... 84/293

[58] Field of Search ..... 84/291, 293, 267

[56] References Cited

U.S. PATENT DOCUMENTS

| | | | |
|---|---|---|---|
| 3,805,663 | 4/1974 | Okugawa | 84/293 |
| 4,184,404 | 1/1980 | Tomioka | 84/293 |
| 4,308,780 | 1/1982 | Boucher | 84/293 |
| 4,528,886 | 7/1985 | Fender | 84/293 |
| 4,846,039 | 7/1989 | Mosher | 84/293 |
| 5,239,908 | 8/1993 | Attias | 84/267 |

*Primary Examiner*—Michael L. Gellner
*Assistant Examiner*—Patrick J. Stanzione

[57] ABSTRACT

A musical instrument neck consisting of three horizontally oriented laminations. The neck using the benefits of stability associated with laminations—with the acoustically preferred method of re-aligning grain patters for increased but not overpowering sympathetic response. The neck also using material orientation and joining matrices to form directional stabilities not considered in prior art.

14 Claims, 3 Drawing Sheets

LAMINATED MUSICAL INSTRUMENT NECKS

BACKGROUND OF THE INVENTION

1. Field of Invention

This invention relates to musical instruments, specifically to necks of stringed instruments.

2. Description of Prior Art

Musical instrument design has an extensive history that parallels general wood working principles. Traditional stringed instrument neck's consist of vertically dimentioned sections of wood, laminated with consideration of wood grain, (as would be commonly understood by someone who is versed in the art of general wood working) and having a horizontally dimentioned section laminated on top (fretboard) 26 FIG. 6. By using "quartersawn" woods (vertically oriented grain that is more expensive to manufacture and purchase) it was believed that this configuration would be the structurally strongest arrangement, and the most stable with regards to wood shifting over time.

Traditional necks were not structurally strong enough to use steel strings without "truss rods" (steel reienforcements—adjustable or fixed) because the necks would bend under the tension of the strings, in the direction of the strings, causing a bow in the fretboard in relation to the strings.

Further, side to side bows were common, where the necks would stand higher on the top right part of the fretboard (for example) and again at the bottom left part of the fretboard, so that a twisting in the neck was evident. These types of defects would often prove to be fatal to the life of the instrument.

Modern variations in traditional designs include using a single piece of wood with a truss rod inserted in a channel that is plugged, leaving a "skunk stripe" on the back of the neck, or a single piece of wood with a separate fretboard added to allow the insertion of a truss rod without the resultant "skunk stripe". Neither of these approaches benefit from the stability generated by laminating alternating grain patterns.

Another variation is to offer multiple vertical laminations—which is aesthetically displeasing since it begins to resemble plywood.

SUMMARY OF THE INVENTION

Accordingly, several objects and advantages of the present invention are:

(a) increased structural strength to the point that no truss rod is required to counter the tension of steel strings.

(b) the elimination of side to side bows, or twisting in the neck.

(c) a neck that is more responsive due to the more direct transmission of sound to the body of the instrument, since the neck is more stable and stronger.

(d) less audio cancellation between the vibrations of the string and the neck.

(e) a neck that is acoustically sympathetic to itself without causing "Wolf Tones" or standing waves, and is hence, more responsive to the player.

(f) a neck that can use less expensively dimensioned hardwoods (ie. flatsawn).

(g) a neck that is aesthetically superior to traditional designs.

(h) The ability during manufacture to pre- bend and shape the neck to counter string stress forces that will be applied during the life of the musical instrument.

(i) a fretboard who's signature contour will remain constant as string pressure is applied.

Further objects and advantages of the invention will become apparent from a consideration of the drawings and ensuing description.

DESCRIPTION OF THE PREFERRED EMBODIMENTS

Figure 4:
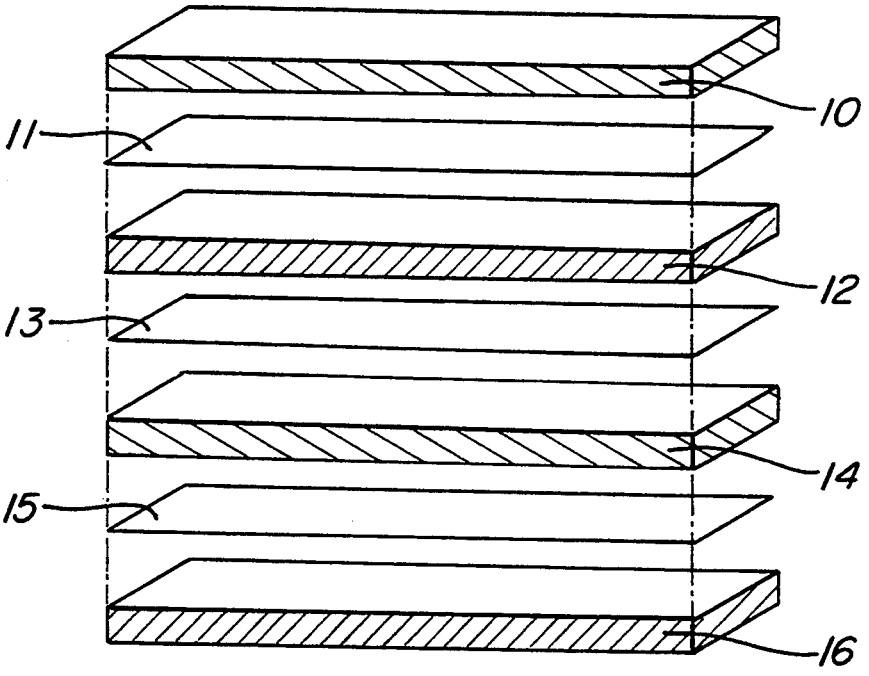
FIG. 4 is an exploded view of the lamination scheme of the neck.

FIG. 4 shows an exploded perspective of the preferred embodiment of the invention. A top piece of hardwood (or other material) designated 10, has been cut from plank A (for example) as has a third piece of hardwood designated 14.

Likewise, a second piece of hardwood designated 12 has been cut from plank B (for example) as has a fourth piece designated 16.

With all four pieces of hardwood depicted in FIG. 4 the wood is re-oriented to approximate the original wood grain of plank's A and B to the closest possible extent.

Glue lines between boards 10, 12, 14, and 16 are depicted in FIG. 4 by 11, 13, and 15.

Figure 1:
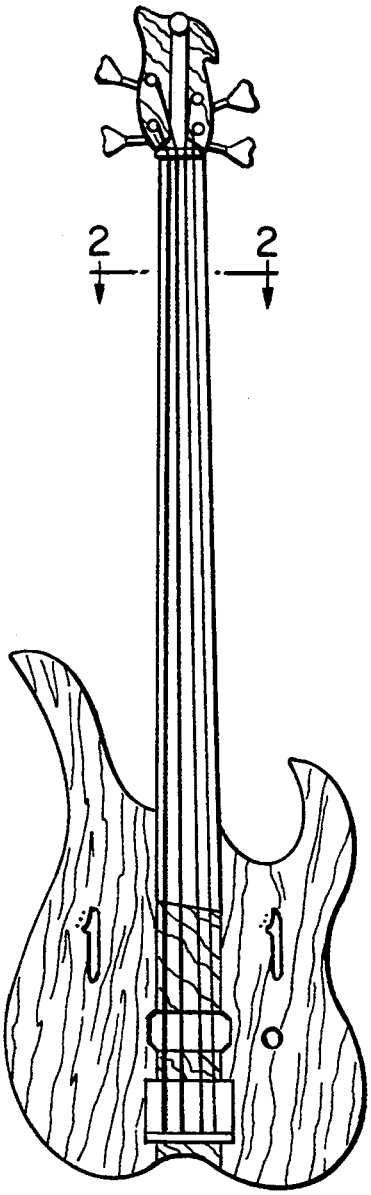
FIG. 1 is a front elevational view of a stringed musical instrument.
Figure 2:
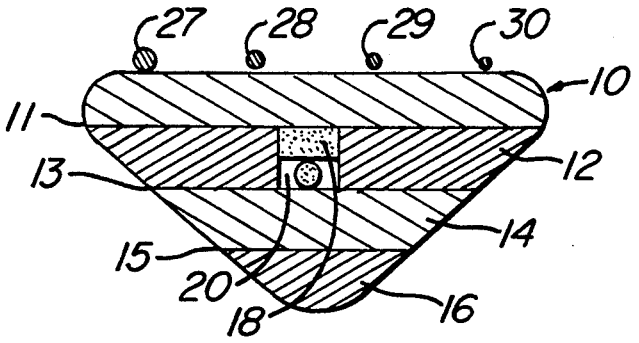
FIG. 2 is a cross sectional view of the portion indicated by the section lines 2 in FIG. 1.

FIG. 1 is a front elevational view of a completed musical instrument. The portion indicated by section lines 2 in FIG. 1 is shown as a cross section in FIG. 2. As the preferred embodiment of the invention, FIG. 2 includes a cross sectional view of truss rod 18 and truss rod channel 20. The truss rod depicted is the "double expanding" type which consists of a 3 mm.×6.5 mm. rectangular piece of steel which acts against a 5 mm. steel rod. There are many variations in truss rod design. FIG. 2 also shows a cross sectional view of musical instrument string's 27, 28, 29, and 30.

Figure 3:
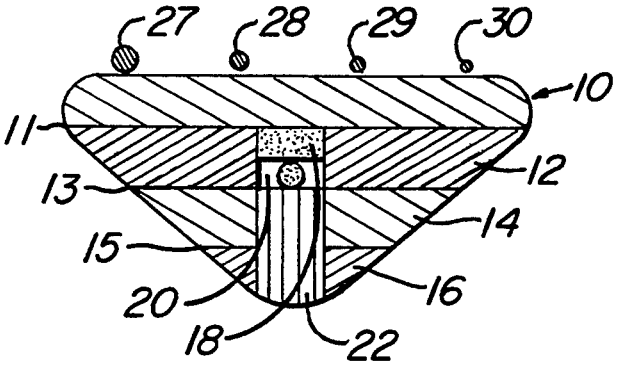
FIG. 3 is a similar cross sectional view containing the modification of an additional vertical section.

FIG. 3 is a similar cross sectional view with the modification that a single vertically oriented piece of material 22 has been included. One or more of these vertically dimentioned pieces may be included, either centrally or off center of the resultant neck.

Figure 5:
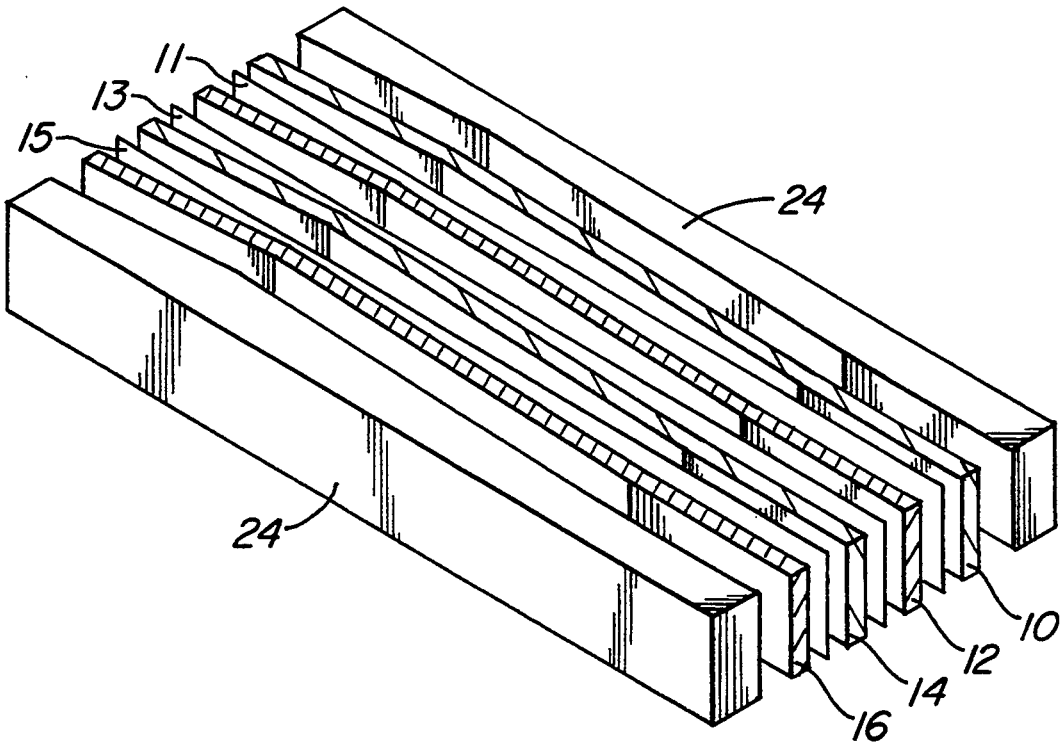
FIG. 5 is a side view of the same lamination scheme showing the use of a mold to shape the resultant neck.

FIG. 5 depicts the lamination process of the invention. Any single piece of the four board's described as 10, 12, 14, 16 is capable of changing the straightness or curvature of the resultant neck. Though the bottom three boards 16, 14, 12, may have a large bow in the direction of the string pull for example (up bow) the last piece, fretboard 10 can be laminated in a position to counter bend of the bottom three. Board 10 then forms a surface matrix with glue joint 11 that is strong enough to shape the entire resultant neck to flat or to back bow (away from the pull of the strings). This attests to the individual structural power of the components of the neck and the overall structural integrity of the neck when all components are assembled in harmony; a harmony that works to resist individual component directional changes due to expansion and contraction from temperature changes, or warping caused by extreme variations in moisture, relative to the time of assembly.

Further, in assembly, the lamination process can be used to pre-shape a curve in the neck relative to the strings, to counter further structural effects caused by joining the neck of the instrument to the body of the instrument.

If a neck were the same thickness and width longitudinally from to top to bottom and string pressure were applied to this simple neck the resultant bow in the neck from string tension would be consistent and bell shaped with regard to the strings.

However, real necks are thinner and narrower on top and thicker and wider on the bottom which causes a greater amount of curve at the top and a flattening out of the bow caused by string tension at the bottom part of the neck, near the body.

Further, where the neck joins the body, the body's mass acts to stabilize or flatten out the bow of the neck caused by string tension, which detracts further from a consistent bell shaped curve in the neck from top to bottom.

In practice, by using a pre-shaped form 24 (FIG. 5) designed to counter distortions caused by the changes in the thickness and width of the neck from top to bottom, and the further distortions caused when the body mass of the instrument is joined to part of the neck of the instrument, the neck can be pre-laminated into a shape that will be brought true and desirable when all forces are brought into play. This can not be done with traditional designs made from several pieces of hardwood.

Figure 6:
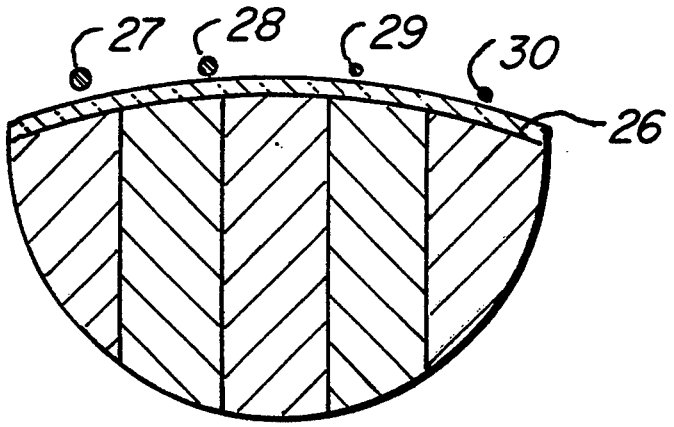
FIG. 6 is the cross sectional view of a traditional instrument neck, which would correspond to the section lines 2 in FIG. 1.

FIG. 6 shows a cross sectional view (less truss rod) of a traditional neck design with the fretboard designated 26.

In the operation of the described invention, as the neck of a musical instrument, a piece of material 10, becomes the "fretboard" of the instrument which strings 27, 28, 29, and 30 are pressed upon to create notes of different musical values (FIG. 2). Under the fretboard 10 it is common to include a channel 20 (or two) in board 12 into which a truss rod 18 (or two) can be inserted, becoming structurally part of the neck.

Beneath fretboard 10 can be two or more pieces of material, arranged horizontally; or one or more horizontal pieces with vertically arranged material (22) inserted as a variation of the preferred embodiment previously described (FIG. 3).

In practice (FIG. 2) the pieces below the fretboard 12,14,16 are laminated together, a truss rod channel 20 is cut, a truss rod 18 inserted, and the fretboard 10 laminated to the bottom pieces, encapsulating the truss rod 18.

The lamination lines 11, 13, 15, are the true sources of strength in FIGS. 2,3,4. As anyone conversant in the process of lamination is aware, the glue joints are stronger than the adjacent woods. Here in is the benefit of the invention's lamination technique which is not obvious. These horizontal laminations combine to create tremendous strength in the vertical plane. Since the surface area's of glue joints 11, 13, and 15 are large in relation to the overall composite of board's 10, 12, 14, and 16, and since the distances between glue joints are small and unlikely to compress, as are the glue joints themselves; being harder than board's 10, 12, 14, and 16, stability in the vertical plane is greater than with previous methods of neck making.

In the horizontal plane stability is also insured by the glue joint surface area's described above.

Since directional stability is enhanced by this lamination design it is no longer necessary or desirable to use (more expensive) "quartersawn" wood's exclusively. While wood grain is stronger in the "quartersawn" direction it is not necessarily more stable. By combining a "quartersawn" plank (A for board's 10 and 12 for example) with a flat sawn plank (B for board's 14 and 16 for example) dimensional stability is insured as well as directional stability. In all directions expansion and contraction is arrested by glue joints 11, 13, 15, while conflicting grain patterns insure rigid stability.

Though wood expands more in the "flatsawn" direction than the "quartersawn" direction, the confliction of both effects sum to near zero.

While I believe that this is the explanation for increased stability and responsiveness I do not wish to be bound by this belief.

Additionally aesthetic benefits ensue from the invention. Since Maple is a standard for the industry we will consider this material for example. Any piece of maple cut in the "quartersawn" direction, (excluding burl, which is not suitable for necks) is extremely unattractive in appearance. "Flatsawn" maple can feature visually exciting variations in grain such as fiddleback, quilted, blistered, and figured patterns, all of which are opalescent and holographic in appearance. Other hardwoods are usually supplied "quartersawn" as a matter of coarse, such as bubinga and zebra; for reasons of stability or tree size. In the case of maple, combining "quartersawn" material with "flatsawn" material increases the aesthetic value of the neck. In the preferred embodiment of the invention, since strength in the vertical plane is insured by the lamination scheme, the use of "flatsawn" material is not detrimental, but assists dimensional stability. It should also be apparent that using material as it is most commonly supplied by the lumber industry can present an economic savings as in the example of "flatsawn" vs. "quartersawn" maple.

As briefly described earlier, the inventor believes that it is the large matrix of rigid material that is formed by the invention that gives each part and the sum of the parts superior stability.

Since, as shown in FIG. 2, (the preferred embodiment of the invention) the boards 10, 12, 14, and 16 are only 6 mm. to 8 mm. of thick @, they can not easily be compressed between glue joints 11, 13, 15. And since the boards 10, 12, 14, 16 are being held rigidly relative to each other by glue joints 11, 13, 15, and since glue joints 11, 13, 15 are stronger than boards 10, 12, 14, 16 as is commonly understood in the art of joining, boards 10, 12, 14, and 16 must compress between glue joints 11, 13, 15 before any distortions in the neck may occur.

Therefore relative stability between the components of the invention combine to create a neck that is more stable than could be generated by other means, with regard to forces acting against the neck from without and within.

Though the neck will bend as string pressure is applied, the desired shape of the neck relative to the string does not change as greatly as with previous designs. Greater stability and longevity of the neck shape relative to the string is insured.

In the preferred embodiment of the invention (FIG. 4) board's 10 and 14 are cut from the same piece of hardwood (A for example), as are board's 12 and 16 (B for example). By re-aligning board's 10 and 14 in the vertical plane and board's 12 and 16 likewise, 10 and 14 can be found to be sympathetic to each other as can 12 and 16. With the intervening influence of board's 12 between 10 and 14, and 14 between 12 and 16 the overall effect of two sets of sympathetic materials produces a neck that is more responsive (sympathetic to itself acoustically) without creating "wolf tones" (certain notes being extremely loud in contrast with others) or standing wave forms in the neck. While plank's A and B originally contained resident resonate frequencies, the combination of board A and B act to cancel what would be overly offensive standing waves; while at the same time combine to form a consistently more acoustically responsive neck.

While the inventor believes that this is the cause of benefits of the invention, he does not wish to be bound by this.

What I claim is:

1. A neck for a stringed musical instrument having strings extending generally parallel to the neck, said neck comprising:

at least three hardwood laminations secured together in direct contact and extending beneath and generally parallel to said strings, and each of said hardwood laminations having a surface in confronting relation with and secured in direct contact to a confronting surface of at least one other hardwood lamination, said hardwood laminations being secured together, whereby said neck is structurally stabilized and strengthened against internal and external destabilizing forces, and the musical instrument is more responsive.

2. A neck for a stringed musical instrument according to claim 1, wherein:

said hardwood laminations have their grains oriented at substantial angles of said confronting surfaces.

3. A stringed instrument neck according to claim 1, wherein:

said neck comprises at least three hardwood laminations.

4. A stringed musical instrument neck according to claim 1, wherein:

said neck provides a fretboard for the instrument.

5. A neck for a stringed musical instrument according to claim 4, wherein:

said neck and laminations define a generally V-shaped tapered cross-sectional configuration, whereby-said neck is adapted to accommodate the thumb and fingers of a user.

6. A neck for a stringed musical instrument according to claim 1, and further including:

at least one truss rod within and extending longitudinally of said neck.

7. A neck for a stringed musical instrument according to claim 1, and further including:

at least two truss rods within and extending longitudinally of said neck.

8. A neck for a stringed instrument according to claim 1, and further including:

one or more sections of material which is inserted beneath and is at substantial angles to said strings.

9. A neck for a stringed musical instrument according to claim 8, wherein:

said neck and laminations define a generally V-shaped tapered cross-sectional configuration, whereby said neck is adapted to accommodate the thumb and fingers of a user.

10. A neck for a stringed musical instrument according to claim 1, wherein:

laminations are oriented with or without regard to grain orientation.

11. A neck for a stringed musical instrument according to claim 1, wherein:

said neck and laminations define a generally V-shaped tapered cross-sectional configuration, whereby said neck is adapted to accommodate the thumb and fingers of a user.

12. A neck for a stringed musical instrument according to claim 1, wherein:

the laminated hardwood neck provides an integrated structure for improved stability with regard to internal and external destabilizing forces over an extended period of service.

13. A neck for a stringed musical instrument according to claim 1, and further including:

at least one section of graphite or other synthetic, acting as a truss rod, embedded within, and extending longitudinally of said neck.

14. A neck for a stringed musical instrument according to claim 13, wherein:

said neck and laminations define a generally V-shaped tapered cross-sectional configuration, whereby said neck is adapted to accommodate the thumb and fingers of a user.

* * * * *

UNITED STATES PATENT AND TRADEMARK OFFICE

CERTIFICATE OF CORRECTION

PATENT NO. : 5,445,058

DATED : August 29, 1995

INVENTOR(S) : Clare L. Hoke, Jr.

It is certified that error appears in the above-identified patent and that said Letters Patent is hereby corrected as shown below:

Column 5, claim 3, line 3, change "three" to read--four--.

Signed and Sealed this

Sixth Day of February, 1996

Bruce Lehman

*Attest:*

BRUCE LEHMAN

*Attesting Officer*

*Commissioner of Patents and Trademarks*